US008342144B2

(12) United States Patent
Busse et al.

(10) Patent No.: US 8,342,144 B2
(45) Date of Patent: Jan. 1, 2013

(54) MOTOR CONTROL STRATEGY FOR A HYDRAULIC CAMSHAFT ADJUSTER HAVING A MECHANICAL CENTRAL LOCK

(75) Inventors: Michael Busse, Herzogenaurach (DE); Lutz Witthoeft, Aurachtal (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 420 days.

(21) Appl. No.: 12/743,070

(22) PCT Filed: Oct. 27, 2008

(86) PCT No.: PCT/EP2008/064542

§ 371 (c)(1),
(2), (4) Date: May 14, 2010

(87) PCT Pub. No.: WO2009/062839

PCT Pub. Date: May 22, 2009

(65) Prior Publication Data

US 2010/0241338 A1 Sep. 23, 2010

(30) Foreign Application Priority Data

Nov. 15, 2007 (DE) ..... 10 2007 054 547

(51) Int. Cl.
*F01L 1/34* (2006.01)

(52) U.S. Cl. ..... 123/90.11; 123/90.12; 123/90.17; 123/90.31

(58) Field of Classification Search .... 123/90.11–90.12, 123/90.15–90.18, 90.31, 90.5, 90.55, 196 M, 123/179.18; 701/105, 113
See application file for complete search history.

(56) References Cited

U.S. PATENT DOCUMENTS

| | | | | |
|---|---|---|---|---|
| 6,450,137 | B2 | 9/2002 | Ogawa | |
| 6,684,835 | B2 | 2/2004 | Komazawa | |
| 7,178,495 | B2 * | 2/2007 | Knecht et al. | 123/90.17 |
| 7,198,014 | B2 * | 4/2007 | Kanada et al. | 123/90.17 |
| 7,703,426 | B2 * | 4/2010 | Weber | 123/90.17 |
| 8,047,170 | B2 * | 11/2011 | Strauss et al. | 123/90.17 |
| 2002/0134334 | A1 | 9/2002 | Yamada et al. | |
| 2003/0000489 | A1 | 1/2003 | Majima | |
| 2003/0121486 | A1 | 7/2003 | Komazawa | |
| 2003/0188705 | A1 | 10/2003 | Aimone | |
| 2012/0118252 | A1 * | 5/2012 | Busse | 123/90.15 |

FOREIGN PATENT DOCUMENTS

| | | | |
|---|---|---|---|
| DE | 100 64 222 | A | 8/2001 |
| DE | 103 44 816 | A | 5/2004 |
| DE | 10 2005 036915 | A | 2/2007 |
| GB | 2 352 775 | A | 2/2001 |
| JP | 2001 050063 | A | 2/2001 |
| WO | WO 2005/049976 | * | 6/2005 |

* cited by examiner

*Primary Examiner* — Hai Huynh
(74) *Attorney, Agent, or Firm* — Lucas & Mercanti, LLP; Klaus P. Stoffel

(57) ABSTRACT

A motor control strategy for a hydraulic camshaft adjuster. The motor control strategy has a mechanical central lock which in turn has at least one rotor and one stator, between which hydraulically loadable chamber A and chambers B are provided. Locking pistons supported in an axially displaceable manner are provided in the rotor for the mechanical central lock. A hydraulic system and an electrically controllable solenoid valve are provided. The valve is powered in a controlled manner by a motor control device, which receives an "ignition off" signal; the motor being turned off, and at least one signal for current angular position of the camshaft adjuster, which compares the angular position to at least one zone definition stored in the motor control device, forms control commands from the same, and transmits said the control commands to the electric solenoid valve.

5 Claims, 3 Drawing Sheets

MOTOR CONTROL STRATEGY FOR A HYDRAULIC CAMSHAFT ADJUSTER HAVING A MECHANICAL CENTRAL LOCK

This application is a 371 of PCT/EP2008/064542 filed Oct. 27, 2008, which in turn claims the priority of DE 10 2007 054 547.0 filed Nov. 15, 2007, the priority of both applications is hereby claimed and both applications are incorporated by reference herein.

FIELD OF THE INVENTION

The invention relates to an engine control strategy for a hydraulic camshaft adjuster with mechanical central locking, in particular a vane-type hydraulic camshaft adjuster, having the features of the preamble of claim 1.

Camshafts of internal combustion engines are usually driven by crankshafts via a chain or a toothed belt, and here, are continuously adjusted in a closed control loop, with typical adjustment ranges being 40° to 60° crank angle. Crank angles to be set are stored in characteristic maps. Adjustments take place for example hydraulically, fed from the engine oil circuit by means of an electrically actuated control valve, and permit optimized valve control times by means of the parameters of engine load and rotational speed. Depending on the engine concept and number of adjusters, it is thus possible to obtain a considerable reduction in fuel consumption and exhaust-gas emissions and an increase in power and torque.

In the state in which they are not hydraulically braced, camshafts and, fixedly connected thereto, rotors of a hydraulic camshaft adjuster tend to perform acoustically noticeable oscillations on account of alternating torques on the camshaft. Said oscillations can be prevented by means of a mechanical connection of the rotor to the stator and therefore to the crankshaft. A known mechanical connection of said type is the camshaft adjuster locked in the center, that is to say between the LATE and EARLY end stops. Two locking pistons which are axially movable in the rotor, and which are also referred to as pins, can be pressed by means of spring force into a locking slot which is positioned opposite in an axially arranged locking cover which is fixedly screwed to the stator, and thereby lock the rotor and stator to one another in a rotationally fixed manner. Unlocking takes place hydraulically by means of oil pressure from the lubricating oil circuit of the engine, which oil pressure is deflected to the locking pistons by means of a controlled supply of current to a solenoid valve and moves said locking pistons axially out of the locking slot into the rotor such that the rotor and stator are rotatable relative to one another.

Non-hydraulically braced states are typical of the starting of the engine, during which the low rotational speed of the oil pump and the correspondingly low oil pressure in the lubricating circuit of the engine may be insufficient for an oil pressure which holds the position of the rotor relative to the stator. As the rotational speed of the engine increases, friction torques are generated on the camshafts counter to the rotational direction thereof, which friction torques assist central locking if the rotor of the camshaft adjuster has been shut down between the central locking position (CLP) and the EARLY end stop. However, if the rotor of the camshaft adjuster has been shut down between the LATE end stop and CLP upon the stopping of the engine, the adjustment of said rotor by means of friction torques takes place exclusively in the LATE direction, and it is not possible for the rotor to reach the CLP without sufficient oil pressure.

U.S. Pat. No. 6,450,137 B2 discloses a camshaft adjuster whose rotor can be pushed hydraulically relative to the stator either to the EARLY end stop or to the LATE end stop. An electrical control valve connects an inlet to oil under pressure from a pump and an unpressurized return to an oil reservoir alternately to the EARLY end stop or the LATE end stop. The electric control valve is adjusted by a control device. To prevent noises from the camshaft drive, it is the aim for the rotor to be rotated mechanically relative to the stator by the crankshaft during the starting of the engine in such a way that the rotor can be locked centrally with the stator. However, if the rotor of the camshaft adjuster has been shut down between the LATE end stop and CLP upon the stopping of the engine, the adjustment of said rotor by means of friction torques takes place exclusively in the LATE direction, and the CLP can thus be reached only with difficulty and unreliably, such that the acoustically noticeable oscillation of the camshaft is not prevented.

In the case of hydraulic locking of the camshaft adjuster during the starting of the engine, the dependency on oil temperature, residual oil in the oil chambers between the rotor and stator, friction torque and fluctuating camshaft torque is disadvantageous because it takes a certain amount of time for the camshaft adjuster to be locked centrally, and the engine control unit must wait for said period of time before the engine ignition can be activated, with noticeable acoustic events before the central locking and additional loads on the timing assembly, camshafts and adjoining components being possible on account of the oscillations in the non-locked state of the camshaft adjuster.

U.S. Pat. No. 6,684,835 B2 discloses a hydraulic camshaft adjuster, the central locking of which takes place as the engine is shut down. An electronic control unit receives a signal generated as the engine is shut down and also signals which represent the position of the stator relative to the rotor. An electric control valve has five ports, of which a port "pump" receives the oil inflow to the solenoid valve from the lubricating oil circuit of the engine, a port "chamber A" connects the control valve and chambers A of the camshaft adjuster, a port "chamber B" connects the solenoid valve to chambers B of the camshaft adjuster, a port "Pins" connects the solenoid valve to all the locking pistons in the camshaft adjuster, and a port "Tank" connects the oil outlet from the solenoid valve to the lubricating oil circuit of the engine, such that said camshaft adjuster of the prior art discloses in each case one separate oil line to the chambers A, the chambers B and all the locking pistons. For the hydraulic locking of the camshaft adjuster in the CLP, it is possible to resort to an oil temperature which is suitable for the operation of the engine, and the engine control unit can immediately activate the ignition of the engine, with the required variable for said strategy being the angular position of the rotor in the camshaft adjuster before the "ignition off" signal, and with no additional measuring technology in relation to conventional engines being required. According to the teaching of U.S. Pat. No. 6,684,835 B2, the chambers A, the chambers B and the pins are placed into an unpressurized state by the solenoid valve before the central locking, and the locking of the stator and rotor in the center is supposed to take place by means of spontaneous movements of the camshaft which rotate the rotor into a suitable position relative to the stator. Acoustically noticeable events as a result of the lack of hydraulic bracing before the central locking, and additional loads on the timing assembly, camshafts and adjoining components on account of the oscillations in the non-locked state of the camshaft adjuster, are unavoidable with the teaching of U.S. Pat. No. 6,684,835 B2.

It is an object of the invention to provide an engine control strategy for a hydraulic camshaft adjuster, by means of which central locking takes place in a controlled manner without oscillation.

Said object is achieved by means of an engine control strategy for hydraulic camshaft adjusters with mechanical central locking, in particular a hydraulic vane-type camshaft adjuster, having the features of claim 1. The subclaims present advantageous embodiments of the invention.

The invention proposes an engine control strategy for a hydraulic camshaft adjuster with mechanical central locking, having at least one rotor and one stator between which chambers A and chambers B, which can be acted on hydraulically, are provided for the controllable rotation of rotor and stator relative to one another. At least two locking pistons which are mounted in the rotor in an axially movable fashion can be pressed elastically into a locking slot for the mechanical central locking of rotor and stator. A hydraulic system is provided with at least in each case one oil line to chamber A, to chamber B and to the locking pistons of at least one electrically controllable solenoid valve, with it being possible for the locking pistons to be acted on by means of a controlled supply of current to the solenoid valve in such a way that they can be pressed out of the locking slot in order to mechanically decouple the rotor and stator. At least one engine control unit which, when the engine is shut down, receives at least one "ignition off" signal and at least one signal relating to the present angular position of the camshaft adjuster, compares the angular position with comparison values stored in the engine control unit, forms control commands from said comparison and outputs said control commands to the electrical solenoid valve. According to the invention, the comparison values stored in the engine control unit are divided into four zones, and in a zone $A_N$, in which the rotor of the camshaft adjuster is at an angle $\geqq\alpha$ with respect to the CLP in the LATE direction, the solenoid valve is supplied with full current in order to adjust the rotor of the camshaft adjuster in the EARLY direction and to connect the locking pistons to the tank for locking in CLP, in a zone $A_R$, in which the rotor of the camshaft adjuster is at an angle $<\alpha$ with respect to the CLP in the LATE direction, the solenoid valve is initially not supplied with current in order to adjust the rotor of the camshaft adjuster in the LATE direction into the zone $A_N$ and the solenoid valve is subsequently supplied with full current in order to adjust the rotor of the camshaft adjuster in the EARLY direction again and to connect the locking pistons to the tank for locking in CLP, in a zone $B_R$, in which the rotor of the camshaft adjuster is at an angle $<\beta$ with respect to the CLP in the early direction, the solenoid valve is initially supplied with full current in order to adjust the rotor of the camshaft adjuster in the EARLY direction into a zone $B_N$ in which the rotor of the camshaft adjuster is at an angle $\geqq\beta$ with respect to the CLP in the early direction, and the solenoid valve is thereafter not supplied with current in order to adjust the rotor of the camshaft adjuster in the LATE direction and to connect the locking pistons to the tank for locking in CLP, in the zone $B_N$, the solenoid valve is not supplied with current in order to adjust the rotor of the camshaft adjuster in the LATE direction and to connect the locking pistons to the tank for locking in CLP. The locking advantageously takes place in a hydraulically controlled manner at all times until the CLP is reached, such that the rotor is guided in a controlled manner into the CLP, and the locking can take place there without noticeable acoustic events and without additional loads on the timing assembly, camshafts and adjoining components on account of oscillations in the non-braced state of the camshaft adjuster. In particular, the utilization of the residual oil pressure during the stopping of the engine permits locking in CLP independently of the angular position of the rotor in the camshaft adjuster at the idle rotational speed before the stopping of the engine.

In one preferred embodiment of the invention, an energy store, which is designed for example as a hydraulic oil pressure store, is provided for locking the rotor of the camshaft adjuster, which energy store can be charged during engine operation and, in the event of insufficient oil pressure for an adjustment during the engine shut-down process, can be activated so as to provide assistance.

In a further preferred embodiment of the invention, the locking of the rotor of the camshaft adjuster in CLP takes place during an engine start if the locking time during the stopping of the engine is too short, with the locking during the engine start taking place with DF=0% or DF=100% as a function of which of the zones $A_N$, $A_R$ or $B_N$, $B_R$ the rotor 2 of the camshaft adjuster 1 is situated in before the "ignition off" signal. The angular position of the camshaft adjuster during the engine start need advantageously only be determined with extremely low engine rotational speed in the case of locking in CLP during an engine start.

In a further preferred embodiment of the invention, an axial multi-grid locking means is provided for the mechanical central locking of the rotor to the stator in order to effect a further accelerated locking of the rotor to the stator, wherein in the case of angular positions in the idle mode between LATE and the central locking position, with sufficient engine oil pressure, the mechanical central locking during an engine stop functions even without axial multi-grid locking with a slightly longer locking time.

The invention is explained below on the basis of a preferred exemplary embodiment. In the figures.

Figure 1:
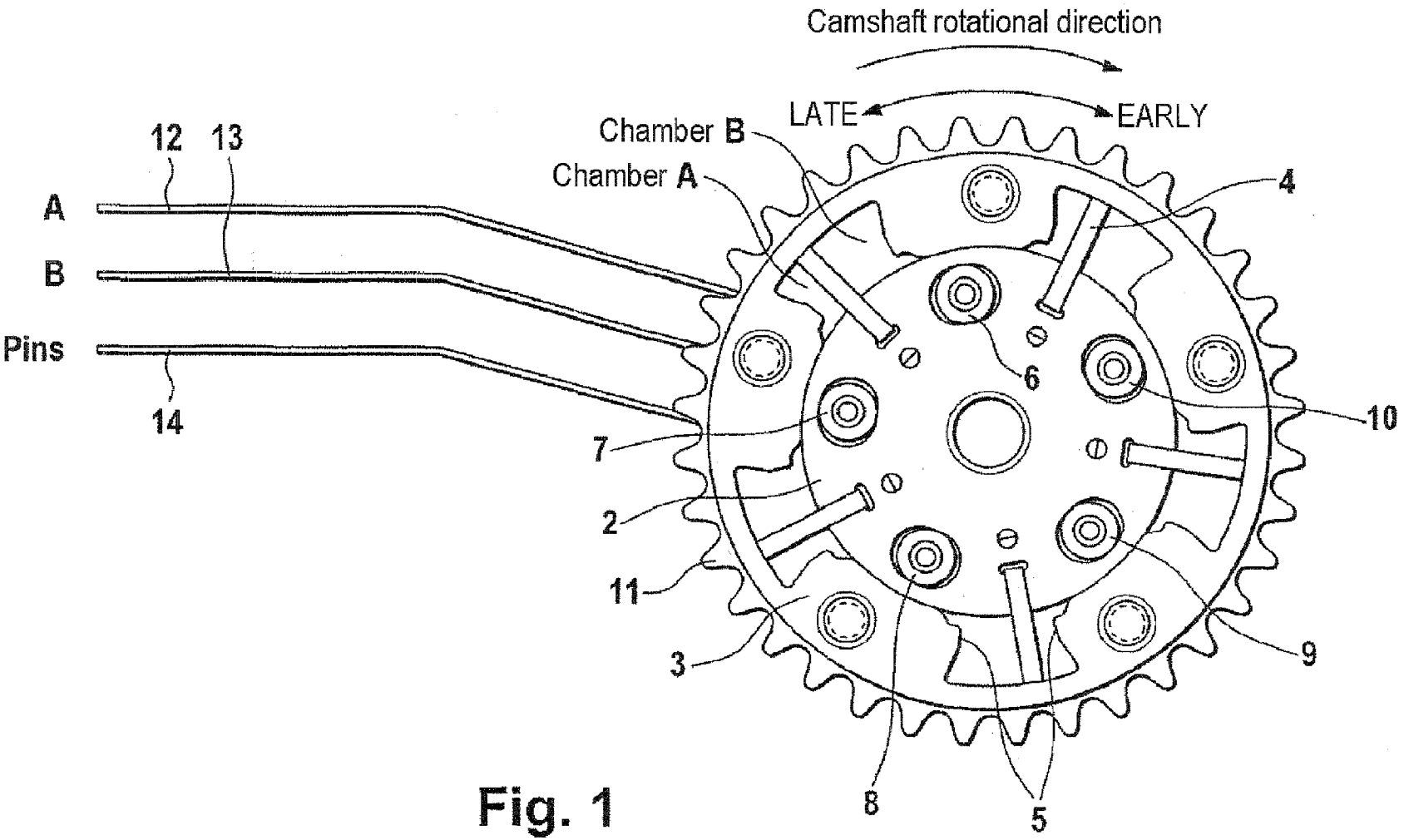
FIG. 1 shows a cross section through a camshaft adjuster for an engine stop strategy according to the invention.

FIG. 1: A hydraulic camshaft adjuster 1 has a rotor 2 and a stator 3, between which a plurality of chambers A and chambers B, which are separated by vanes 4, and are distributed uniformly over the circumference, are provided. Rotor 2 is rotatable relative to stator 3. The vanes 4 which are mounted in the rotor 2 interact with early and late stops 5 distributed uniformly over the inner circumference of the stator 3. Axially movably mounted locking pistons 6-10 are provided in the rotor 2, which locking pistons 6-10 can be pressed by means of springs (not illustrated) into a locking slot of the stator 3 for a connection, which is secured against rotation, of the rotor 2 and stator 3 in CLP. A toothed ring 11 is provided, so as to be directed radially outward, over the entire circumference of the stator 3 for a chain (not illustrated) which leads to a crankshaft.

Of the two locking pistons 6 and 7 for central locking which are axially movable in the rotor and which, as a function of the angular position of the rotor 2 relative to the stator 3, engage into or do not engage into opposite locking slots in the locking cover, locking piston 6 locks in the LATE direction and locking piston 7 locks in the EARLY direction.

An oil line 12 leads from an electrically controllable solenoid valve (not illustrated) from a port A to the chambers A, an oil line 13 leads from a port B to the chambers B and an oil line 14 leads from a port Pins to the locking pistons 6-10 which can be unlocked by means of oil pressure from the port Pins. The solenoid valve is acted on with pressurized oil by means of a pump (not illustrated). Oil can flow, unpressurized, out of the solenoid valve into a tank via a return line (not illustrated).

Figure 2:
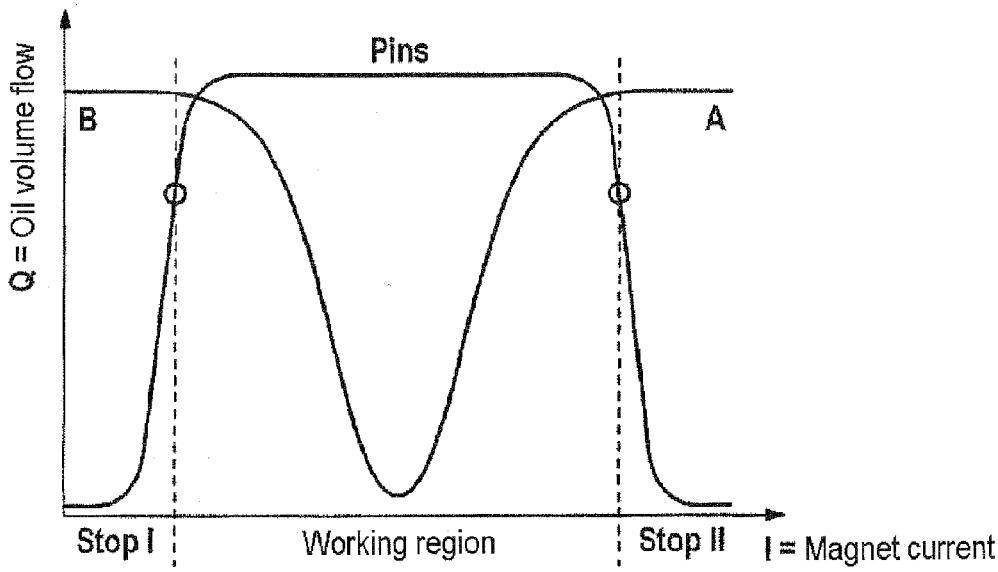
FIG. 2 shows a graph of the control characteristic and switching positions of the solenoid valve for an engine stop strategy according to the invention.

FIG. 2: The electrically controllable solenoid valve is divided into three regions plotted on the abscissa of the graph: stop I for the engine stop strategy for adjustment in the LATE direction, working region for regulation during engine operation and stop II for engine stop strategy for adjustment in the EARLY direction. All the locking pistons 6-10 are connected to the tank in the stop I and stop II regions, such that the rotor can lock the camshaft adjuster in CLP upon the stopping of the engine. The oil pressure in the lines to the locking pistons 6-10 is 0 . . . 0.5 bar in the region of stop I, >0.5 bar in the working region and 0.5 . . . 0 bar in the region of stop II, wherein in the design according to the example, the locking pistons 6, 7 are fully unlocked, for adjustability and controllability of the camshaft adjuster 1 over the full angle range, only above 0.5 bar. Correspondingly different oil pressure limits apply for other designs with other locking springs for the locking pistons 6-10, other locking piston masses, locking piston areas etc.

At oil pressures lower than 0.5 bar, the rotor 2 of the camshaft adjuster 1 cannot be adjusted over CLP because the locking pistons 6-10 are connected to the tank and can therefore lock when passing over CLP.

When the solenoid valve is switched such that the pump acts on the chamber A and at the same time chamber B is connected to the tank, the gas exchange valve control times are adjusted in the EARLY direction, and when the solenoid valve is switched such that the pump acts on the chamber B and at the same time chamber A is connected to the tank, the gas exchange valve control times are adjusted in the LATE direction.

Figure 3:
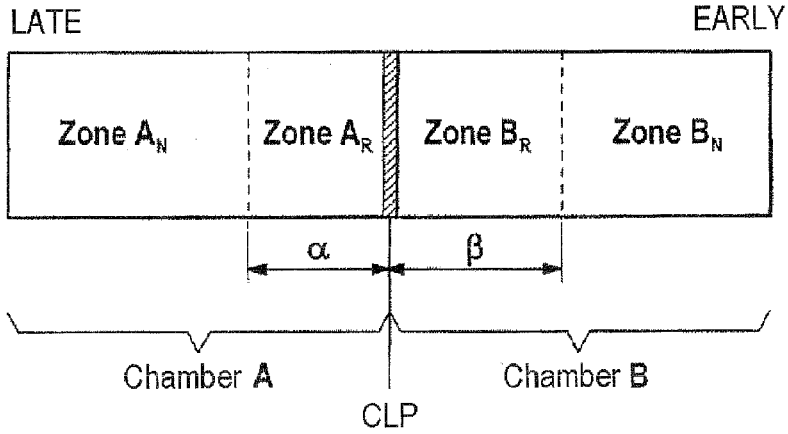
FIG. 3 shows a breakdown of the adjustment angle range for an engine stop strategy according to the invention.

FIG. 3: For the engine stop strategy, the entire adjustment angle range of the rotor 2 in the camshaft adjuster 1 is split up into four zones $A_N$, $A_R$, $B_N$ and $B_R$. Zone $A_N$ is a neutral zone in the chamber A. When the rotor 2 is situated in the zone $A_N$, the distance of said rotor 2 to the CLP is sufficient to reliably lock the locking pistons 6-10 in the locking slots in the event of a pressure drop in the oil line 14. When the rotor 2 is situated in the zone $A_R$, the distance $\alpha$ of said rotor 2 in the late direction to the CLP is too small to reliably lock the locking pistons 6-10 in the locking slots in the event of a pressure drop in the oil line 14, such that the rotor 2 remains rotatable relative to the stator 3. The angle $\alpha$ may be 8°-12°, for example 10°. When the rotor 2 is situated in the zone $B_N$, the distance of said rotor 2 to the CLP is sufficient to reliably lock the locking pistons 6-10 in the locking slots in the event of a pressure drop in the oil line 14, and when the rotor 2 is situated in the zone $B_R$, the distance $\beta$ of said rotor 2 in the EARLY direction to the CLP is too small to reliably lock the locking pistons 6-10 in the locking slots in the event of a pressure drop in the oil line 14, such that the rotor 2 remains rotatable relative to the stator 3. The angle $\beta$ may be 6°-10°, for example 8°, where $\alpha>\beta$, since friction torques act on the camshaft in the LATE direction, and therefore adjusting speeds in the LATE direction are generally greater.

Figure 4:
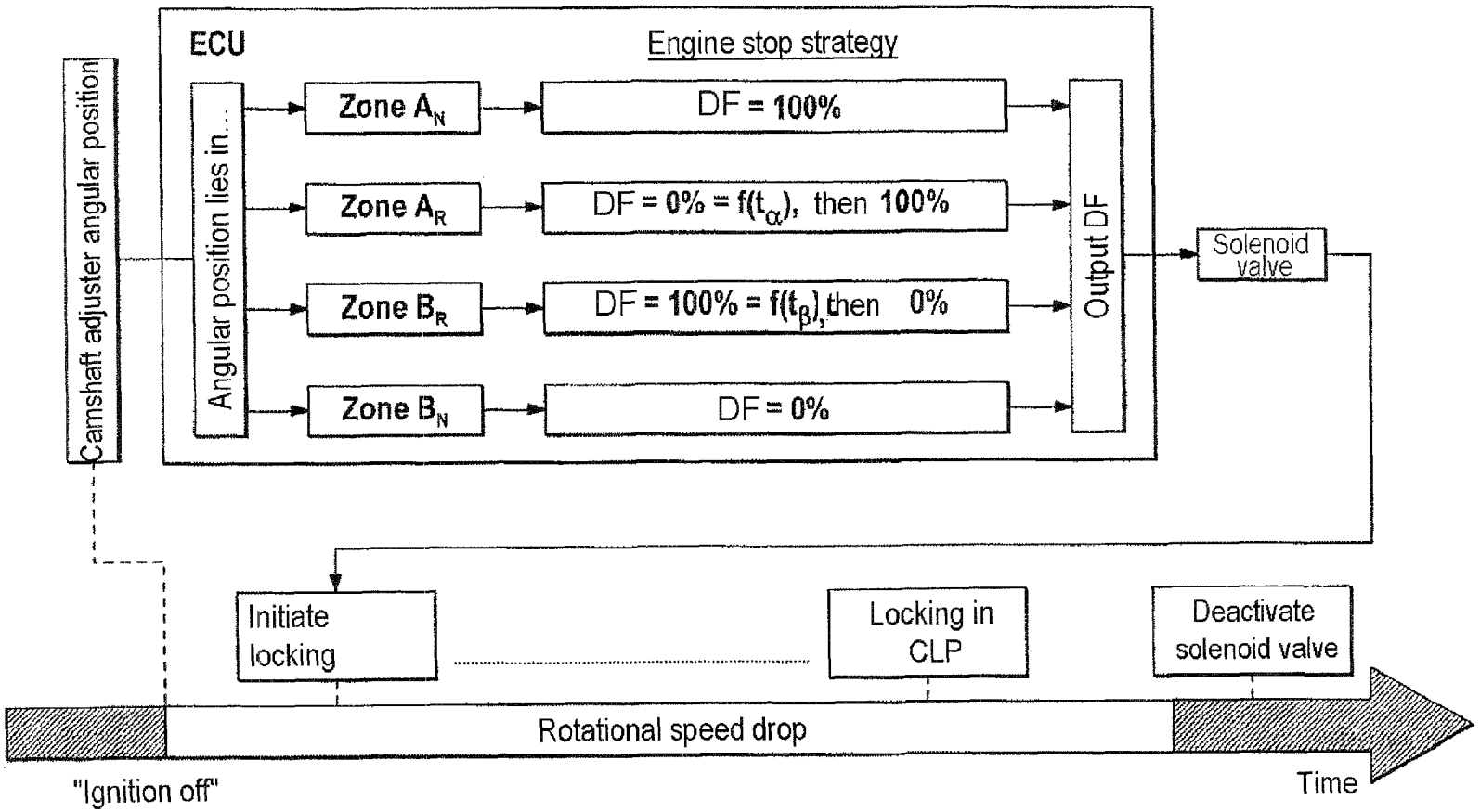
FIG. 4 shows a flow diagram of the engine stop strategy according to the invention.

FIG. 4: In normal operation of the engine at the idle rotational speed, during an engine shut-down process, the locking process takes place chronologically as follows: the driver shuts down the engine and a signal "ignition off" is transmitted to the engine control unit. The engine control unit evaluates the present angular position of the rotor 2 in the camshaft adjuster 1 and compares it with the stored zone definitions. Depending on the detected zone, one of the predefined duty factors (DF) is output by the engine control unit to the solenoid valve.

When the rotor 2 is situated in the zone $A_N$ upon the stopping of the engine, the solenoid valve is acted on with maximum current (DF=100%; region: stop II) in order to adjust the rotor 2 of the camshaft adjuster 1 in the EARLY direction. As a result, the rotor 2 is locked with the stator 3 in CLP, since the locking pistons 6-10 are connected to the tank without pressure.

When the rotor 2 is situated in the zone $A_R$ upon the stopping of the engine, the solenoid valve remains initially without current (DF=0%; region: stop I) in order to adjust the rotor 2 of the camshaft adjuster 1 in the LATE direction into the neutral zone; the solenoid valve is thereafter acted on with maximum current (DF=100%; region: stop II) in order to adjust the rotor 2 of the camshaft adjuster 1 in the EARLY direction. As a result, the rotor 2 is locked with the stator 3 in CLP, since the locking pistons 6-10 are connected to the tank.

When the rotor 2 is situated in the zone $B_R$ upon the stopping of the engine, the solenoid valve is initially acted on with maximum current (DF=100%; region: stop II) in order to adjust the rotor 2 of the camshaft adjuster 1 in the EARLY direction into the neutral zone, and the solenoid valve is thereafter separated from the current (DF=0%; region: stop I) in order to adjust the rotor 2 of the camshaft adjuster 1 in the LATE direction. As a result, the rotor 2 is locked with the stator 3 in CLP, since the locking pistons 6-10 are connected to the tank.

When the rotor 2 is situated in the zone $B_N$ upon the stopping of the engine, the solenoid valve remains separated from the current (DF=0%; region: stop I) in order to adjust the rotor 2 of the camshaft adjuster 1 in the LATE direction. As a result, the rotor 2 is locked with the stator 3 in CLP, since the locking pistons 6-10 are connected to the tank.

The locking of the rotor 2 to the stator 3 in CLP with decreasing rotational speed takes place utilizing the residual oil pressure in the engine.

The camshaft adjuster 1 is normally already locked before the engine comes to a standstill. However, if the locking time during the stopping of the engine is too short, the locking takes place during the engine start, specifically with DF=0% or DF=100% depending on which of the zones $A_N$, $A_R$ or $B_N$, $B_R$ the rotor 2 of the camshaft adjuster 1 is situated in before the "ignition off" signal. When the rotor 2 of the camshaft adjuster 1 is situated in the zones $A_N$, $A_R$, that is to say between LATE and CLP, before the "ignition off" signal, then DF=100% is applied to the solenoid valve. When the rotor 2 of the camshaft adjuster 1 is situated in the zones $B_N$, $B_R$, that is to say between CLP and EARLY, before the "ignition off" signal, then DF=0% is applied, such that the oil pressure always acts in the direction of CLP, that is to say in addition to the camshaft friction torque or grid locking. At the same time, residual oil flows out of the oil chamber, which could prevent an adjustment in the direction of CLP.

The invention claimed is:

1. An engine control strategy for a hydraulic camshaft adjuster with mechanical central locking, comprising:

at least one rotor and one stator between which chambers A and chambers B, which can be acted on hydraulically, are provided for controllable rotation of the rotor and the stator relative to one another, at least two locking pistons which are mounted in the rotor in an axially movable fashion and which can be pressed elastically into a locking slot for the mechanical central locking of the rotor and the stator, at least one hydraulic system with at least in each case one oil line to chamber the A, to the chamber B and to the locking pistons of at least one electrically controllable solenoid valve, with it being possible for the locking pistons to be acted on by means of a controlled supply of current to the solenoid valve in such a way that the locking pistons can be pressed out of the locking slot in order to separate the rotor and the stator, having at least one engine control unit which, when the engine is shut down, receives at least one "ignition off" signal and at least one signal relating to the present angular position of the camshaft adjuster, compares the angular position with at least one zone definition stored in the engine control unit, forms control commands from said comparison and outputs said control commands to the electrical solenoid valve, wherein, in a zone $A_N$, in which the rotor of the camshaft adjuster is at an angle $\geqq\alpha$ with respect to a CLP in a LATE direction, the solenoid valve is supplied with full current in order to adjust the rotor of the camshaft adjuster in an EARLY direction and to connect the locking pistons to the tank for locking in CLP, in a zone $A_R$, in which the rotor of the camshaft adjuster is at an angle $<\alpha$ with respect to the CLP in the LATE direction, the solenoid valve is initially not supplied with current in order to adjust the rotor of the camshaft adjuster in the LATE direction into the zone $A_N$ and the solenoid valve is subsequently supplied with full current in order to adjust the rotor of the camshaft adjuster in the EARLY direction again and to connect the locking pistons to the tank for locking in CLP, in a zone $B_R$, in which the rotor of the camshaft adjuster is at an angle $<\beta$ with respect to the CLP in the early direction, the solenoid valve is initially supplied with full current in order to adjust the rotor of the camshaft adjuster in the EARLY direction into a zone $B_N$ in which the rotor of the camshaft adjuster is at an angle $>\beta$ with respect to the CLP in the early direction, and the control valve is thereafter not supplied with current in order to adjust the rotor of the camshaft adjuster in the LATE direction and to connect the locking pistons to the tank for locking in CLP, in the zone $B_N$, the control valve is not supplied with current in order to adjust the rotor of the camshaft adjuster in the LATE direction and to connect the locking pistons to the tank for locking in CLP.

2. The engine control strategy of claim 1, wherein the camshaft adjuster can be locked in CLP during an engine start, with the locking during the engine start taking place with DF=0% or DF=100% as a function of which of the zones $A_N$, $A_R$ or $B_N$, $B_R$ the rotor of the camshaft adjuster is situated in before the "ignition off" signal.

3. The engine control strategy of claim 1, wherein the locking of the rotor of the camshaft adjuster in CLP with decreasing rotational speed takes place in each case utilizing the residual oil pressure in the engine.

4. The engine control strategy of claim 1, wherein an energy store is alternatively provided for the locking of the rotor of the camshaft adjuster.

5. The engine control strategy of claim 1, wherein an axial multi-grid locking means is provided for the mechanical central locking of the rotor to the stator.

* * * * *